United States Patent [19]

Soshiki et al.

[11] 4,180,448

[45] Dec. 25, 1979

[54] PROCESS FOR PREPARATION OF PLASTIC MOLDED ARTICLES HAVING METAL FILM

[75] Inventors: Yoshikazu Soshiki; Hiroshi Sugiura, both of Okazaki; Kouzi Onizawa, Anjyo; Toshikatsu Togawa, Aichi; Minoru Kojima, Inuyama; Tsukio Morikawa, Aichi; Naohiko Kurimoto, Yokohama; Hiromitu Katou, Kasugai, all of Japan

[73] Assignees: Mitsubishi Jidosha Kogyo Kabushiki Kaisha, Tokyo; Sakae Riken Kogyo Co., Ltd., Aichi; Dai Nippon Toryo Co., Ltd., Osaka, all of Japan

[21] Appl. No.: 969,000

[22] Filed: Dec. 13, 1978

[30] Foreign Application Priority Data

May 22, 1978 [JP] Japan ..... 53-61194

[51] Int. Cl.[2] ..... C23C 15/00

[52] U.S. Cl. ..... 204/192 C

[58] Field of Search ..... 204/192 C, 192 P; 427/250, 404

[56] References Cited

U.S. PATENT DOCUMENTS

| | | | |
|---|---|---|---|
| 3,177,134 | 4/1965 | Gartner et al. | 204/192 |
| 3,783,012 | 1/1974 | Morita et al. | 427/250 X |
| 3,984,907 | 10/1976 | Vossen, Jr. et al. | 29/195 |
| 4,022,947 | 5/1977 | Grubb et al. | 428/432 |
| 4,028,206 | 6/1977 | King | 204/192 C |
| 4,039,722 | 8/1977 | Dickie et al. | 428/461 |
| 4,101,402 | 7/1978 | Vossen, Jr. et al. | 204/192 C |
| 4,131,530 | 12/1978 | Blum et al. | 204/192 C |

FOREIGN PATENT DOCUMENTS

| | | | |
|---|---|---|---|
| 264102 | 6/1970 | U.S.S.R. | 204/192 C |

OTHER PUBLICATIONS

J. C. Thornton, "Sputter Deposition onto Plastics", *Metal Finising,* Jul. 1976, pp. 46–51.

*Primary Examiner*—Aaron Weisstuch

*Attorney, Agent, or Firm*—Bucknam and Archer

[57] ABSTRACT

The present invention relates to a process for the preparation of plastic molded articles having a metal film and exhibiting a metallic luster, said process comprising (a) coating an ultraviolet-curing acrylic resin type undercoating paint on the surface of a plastic molded article and irradiating the molded article with ultraviolet rays to form a base coat layer, (b) forming a metal film layer of chromium or stainless steel on the base coat layer by a sputtering process, and (c) coating on the metal film layer a top coating paint comprising as main components an acryl polyol having an OH value of 10 to 200 and an acid value of 1 to 12 and a non-yellowing polyisocyanate and curing the top coating paint to form a top coat layer.

6 Claims, 1 Drawing Figure

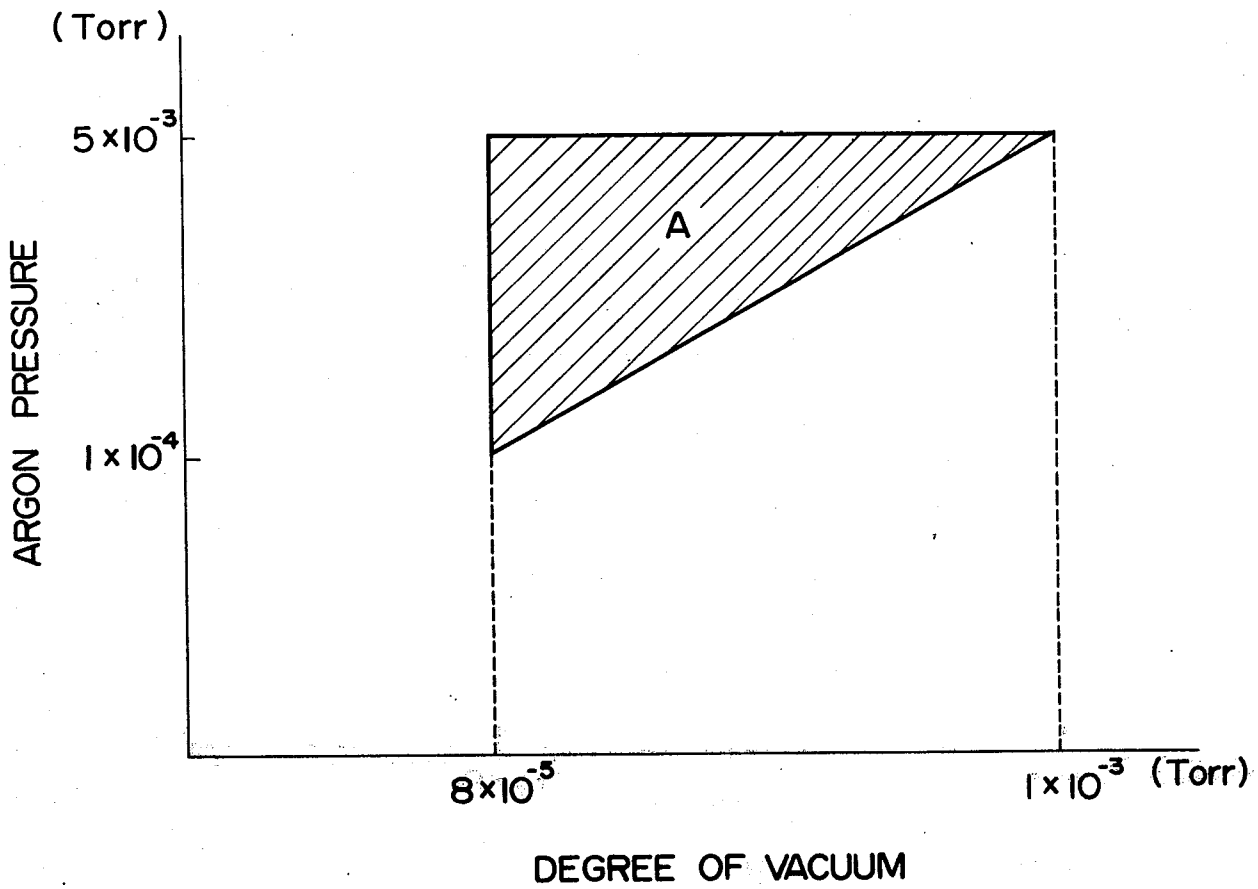
ARGON PRESSURE
(Torr)
5×10⁻³
1×10⁻⁴
A
8×10⁻⁵
1×10⁻³ (Torr)
DEGREE OF VACUUM

PROCESS FOR PREPARATION OF PLASTIC MOLDED ARTICLES HAVING METAL FILM

BACKGROUND OF THE INVENTION (1) Field of the Invention

The present invention relates to a process for the preparation of plastic molded articles having a metal film. More particularly, the invention relates to a process for the preparation of plastic molded articles which exhibit a metallic luster and have a thin metal film in the surface layer.

(2) Description of the Prior Art

The optimum method for forming a plastic molded article having a metallic appearance is one comprising forming a metal film on the surface of the molded article. Known conventional methods for forming such a metal film are a vacuum deposition method, a hot stamp method, a plating method and the like.

These conventional methods, however, involve difficulties and problems in connection with the properties of products and the process steps and thus are satisfactory.

For example, in the vacuum deposition method, as described in Japanese Patent Publication No. 39912/78 (Published Unexamined Japanese Patent application No. 138064/75) and Japanese Patent Publication No. 39913/78 (Published Unexamined Japanese Patent application No. 138065/75), only metals having a relatively low melting point, such as aluminum, tin and antimony can be used; it is very difficult to use metals having a high melting point, such as chromium. Moreover, the vacuum deposition method is deficient in that mass production is impossible. Furthermore, the hardness of these low-melting-point metals is low and scratches are readily formed. This in turn readily leads to discoloration, corrosion and elution. Therefore, the vacuum deposition method is not suitable for the purpose of exterior decoration.

The hot stamp method is deficient in that the shape or configuration of plastic molded articles is restricted because of processing limitations.

A strong metal film can be obtained by the plating method, for example, by electrolytic plating with chromium. However, the process steps are complicated and post treatment such as waste water treatment is required. Therefore, this method is deficient from economic and industrial viewpoints.

As a means for eliminating these disadvantages, there has recently been proposed a method in which a film of a metal such as chromium is formed according to a low temperature sputtering process. However, cracks are readily formed in the metal film during the film-forming process or during use, the decorative appearance is markedly degraded and the formed metal film readily peels from the coating. Accordingly, even this method has not been put into practical use.

SUMMARY OF THE INVENTION

The present invention relates to a process for the preparation of plastic molded articles, in which a film of chromium or stainless steel having a good metallic luster (comparable or superior to the metallic luster attainable by the plating method) can be formed on a plastic molded article by the low temperature sputtering process, whereby the abovementioned problems of formation of cracks and peeling from the coating can be overcome.

More specifically, in accordance with the present invention, there is provided a process for the preparation of plastic molded articles having a metal film, which comprises (a) coating an ultraviolet-curing acrylic resin type undercoating paint on the surface of a plastic molded article and irradiating the coated molded article with ultraviolet rays to form a base coat layer, (b) forming on the surface of the base coat layer a metal film layer of chromium or stainless steel by a sputtering process conducted under conditions of a degree of vacuum of $6\times10^{-5}$ to $1\times10^{-3}$ Torr, an argon pressure of $1\times10^{-4}$ to $5\times10^{-3}$ Torr, a voltage of 200 to 600 V and a current density of 0.2 to 5 A/dm$^2$, and (c) coating on the surface of the so formed metal film layer of chromium or stainless steel a top coating paint comprising as main components an acryl polyol having an OH value of 10 to 200 and an acid value of 1 to 12 and a non-yellowing polyisocyanate, and curing the top coating paint to form a top coat layer.

BRIEF DESCRIPTION OF THE DRAWING

FIG. 1 illustrates the relation between the degree of vacuum and the argon pressure in forming a metal film by sputtering of chromium or stainless steel, wherein the region A is the region in which an excellent metal film substantially free of cracking is obtained.

DETAILED DESCRIPTION OF THE PREFERRED EMBODIMENTS

Step (a)

In the present invention, if a material constituting the plastic molded article has too large a coefficient of thermal expansion, cracks often form at the metal film-forming step or during use. Accordingly, it is preferred that the coefficient of thermal expansion be small. From the practical viewpoint, a coefficient of thermal expansion of less than $20\times10^{-5}$ cm/cm/°C. is preferred.

As an especially preferred material used to form the plastic molded article, there can be mentioned the known acrylonitrile-butadiene-styrene copolymer (hereinafter referred to as "ABS"), acrylonitrile-styrene copolymers (hereinafter referred to as "AS"), polyamide resins, polyethylene terephthalate resins, nonyl resins and polyphenylene oxide. Of course, a plastic molded article coated or laminated with such a copolymer or resin is also a preferred material.

The ultraviolet-curing acrylic resin type under-coating paint that is used in the present invention comprises as main components (a) a polymerizable acrylic resin component, (b) a polymerizable solvent component and/or (c) a non-polymerizable solvent component, and (d) a photosensitizer component (photo-polymerization initiator component).

As the polymerizable acrylic resin component, there can be mentioned polymethyl methacrylate; relatively low-molecular-weight compounds (oligomers) having in the molecule at least two polymerizable vinyl groups, such as oligomers represented by the following structural formulas (I), (II), (III) and (IV), which are disclosed in, for example, Japanese Patent Publications No. 26300/74 and No. 35073/74:

$$CH_2{=}\overset{\overset{\displaystyle R''}{|}}{C}COA(R'AOCRCOA)_nR'AOC\overset{\overset{\displaystyle R''}{|}}{C}{=}CH_2 \quad \text{(I)},$$

-continued $$CH_2{=}\overset{R''}{\overset{|}{C}}CO(AR''''CO)_nAR'{-}AOC\overset{R''}{\overset{|}{C}}{=}CH_2 \quad \text{(II)},$$

$$CH_2{=}\overset{R''}{\overset{|}{C}}COAR'AOCRCO(AR''''CO)_nAR'{-}AOC\overset{R''}{\overset{|}{C}}{=}CH_2 \quad \text{(III)},$$

and $$CH_2{=}\overset{R''}{\overset{|}{C}}{-}COOCH_2\overset{OX}{\overset{|}{C}}HCH_2OOCRCO(OR'OOCRCO)_n{-}OCH_2\overset{OX}{\overset{|}{C}}HCH_2{-}OC{-}\overset{R''}{\overset{|}{C}}{=}CH_2 \quad \text{(IV)}$$

wherein A stands for —O— or—NH— with the proviso that at least one A is —NH—, R stands for a divalent hydrocarbon group having 1 to 10 carbon atoms, R' stands for a divalent saturated hydrocarbon group having 2 to 10 carbon atoms, R'' stands for H or $CH_3$, R'''' stands for a divalent saturated hydrocarbon group having 4 to 10 carbon atoms, X stands for H or R°—CO— in which R° is H, a hydrocarbon group having 1 to 18 carbon atoms, or —NHR, and n is an integer of 0 to 14; polyester-modified acrylic resins, for example, unsaturated group-containing polyester-modified acrylic resins disclosed in, for example, Published Unexamined Japanese Patent application No. 27523/74, which are prepared by subjecting an $\alpha,\beta$-ethylenically unsaturated dicarboxylic acid such as fumaric acid to an addition reaction with epichlorohydrin, esterifying the reaction product with a polycarboxylic acid anhydride such as phthalic anhydride, and subjecting the resulting ester to an addition reaction with an epoxy group-containing vinyl monomer such as glycidyl methacrylate; epoxy-modified acrylic resins, for example, oligomers disclosed in Published Unexamined Japanese Patent Application No. 82742/74, which are prepared by reacting a hydroxyl group-containing vinyl monomer with a saturated polycarboxylic anhydride and reacting with resulting compound with a polyepoxy compound; products obtained by reacting an epoxy resin prepolymer with acrylic acid or the like as disclosed in Japanese Patent Publication No. 19038/69; mixtures of two or more of the foregoing polymerizable resin components; and other polymerizable resin components heretofore used for ultraviolet-curing acrylic resin type paints.

As typical instances of the polymerizable solvent component that can be used in the present invention, there can be mentioned acryloyl or methacryloyl group-containing compounds such as methyl acrylate, methyl methacrylate, ethyl acrylate, ethyl methacrylate, 2-ethylhexyl acrylate, 2-ethylhexyl methacrylate, benzyl acrylate, benzyl methacrylate, 2-hydroxyethyl acrylate, 2-hydroxyethyl methacrylate, ethylene glycol diacrylate, ethylene glycol dimethacrylate, trimethylol propane triacrylate and trimethylol propane trimethacrylate, aromatic monovinyl compounds such as styrene, vinyl toluene and $\alpha$-methylstyrene; and acrylonitrile, vinyl acetate, acrylamide and diacetone acrylamide.

As typical examples of the non-polymerizable solvent compound that can be used in the present invention, there can be mentioned xylene, toluene, methylethyl ketone, acetone, methyl alcohol and ethyl alcohol.

By the term "photosensitizer" used in the instant specification is meant an agent which is capable of generating radicals under ultraviolet actinic rays as polymerization-initiating seeds causing a polymerization reaction. In the present invention, as the photosensitizer component, there can be used, for example, benzoin, benzoin methyl ether, benzoin isopropyl ether, anthraquinone, naphthoquinone, chloro-anthraquinone, tetramethylthiuram disulfide, diphenyl disulfide, benzoyl peroxide, azobisisobutyronitrile, 2,2'-azobispropane diacetyl, acetophenone, benzophenone and dithiocarbamate.

The ultraviolet-curing acrylic resin type undercoating paint that is used in the present invention may further comprise additives such as a polymerization inhibitor, a smoothening or leveling agent and the like according to need.

It is preferred that the polymerizable resin component, the solvent component (polymerizable solvent and/or non-polymerizable solvent) and the photosensitizer component be mixed at a weight ratio of 100:(10 to 200 ):(1 to 20 ).

The ultraviolet-curing acrylic resin type undercoating paint is coated on a degreased surface of a plastic molded article according to a customary coating method such as brush coating, spray coating, dip coating, curtain flow coater coating, roller coating or the like, and the coated paint is irradiated with ultraviolet rays by a low pressure or high pressure mercury lamp, an arc lamp, a xenon lamp or the like and is thus cured.

The dry thickness of the layer of the ultraviolet-curing acrylic resin type undercoating paint preferably is about 10 to about 50$\mu$.

In order to prevent formation of cracks in a metal film to be formed on the so prepared base coat layer, it is preferred that the hardness of the base coat be not lower than HB, especially not lower than F (as determined according to the method of JIS D-0202).

The reason why the ultraviolet-curing acylic resin type undercoating paint is especially chosen and used in the process of the present invention is that since the coating can be dried at a low temperature with little energy, there is no degradation of or damage to the plastic molded article, the surface of the plastic molded article is smoothened and good adhesion can be obtained between the plastic molded article and a metal film.

Step (b)

A metal film of chromium or stainless steel is then formed on the surface of the base coat layer by sputtering.

The process for forming a metal film by sputtering of chromium or stainless steel will now be described in detail, though other processes than the one described below can also be used.

For example, a direct current two-electrode magnetron sputtering apparatus is used. In this apparatus, chromium or stainless steel is used as the cathode target, and argon gas is introduced into a bell jar evacuated to $6\times10^{-5}$ to $1\times10^{-3}$ Torr, preferably $8\times10^{-5}$ to $3\times10^{-4}$ Torr, so that the argon pressure is $1\times10^{-4}$ to $5\times10^{-3}$ Torr, preferably $3\times10^{-4}$ Torr. Discharge is effected between two electrodes at a voltage of 200 to 600 V, preferably 400 to 600 V, and a cathode current density of 0.2 to 5 A/dm$^2$, preferably 1.5 to 2.0 A/dm$^2$.

Argon ions generated by the discharge impinge against chromium or stainless steel of the cathode target to release metal atoms of chromium or stainless steel. The metal ions advance along straight courses in the bell jar and arrive at the surface of the base coat layer. Thus, the metal atoms condense on the surface of the base coat layer to form a metal film thereon.

In the present invention, good sputtering is attained when the voltage between the two electrodes is maintained at 200 to 600 V. If the voltage is lower than 200 V, no sputtering takes place even if discharge is effected. When the voltage exceeds 600 V, various industrial difficulties or disadvantages are brought about.

In the present invention, the current density is adjusted to 0.2 to 5 A/dm$^2$. If the current density is lower than 0.2 A/dm$^2$, no sputtering takes place, and when the current density exceeds 5 A/dm$^2$, the temperature is elevated and the plastic molded article is deformed or cracks are formed on the metal film so that good results cannot be obtained.

When the degree of vacuum is adjusted to $6\times10^{-5}$ to $1\times10^{-3}$ Torr and the argon pressure is maintained in the range of from $1\times10^{-4}$ to $5\times10^{-3}$ Torr, there can be obtained a metal film in which almost no cracks are formed.

When the degree of vacuum or the argon pressure is outside the above range, no sputtering is occurs and even if a metal film is obtained cracks are readily formed therein.

FIG. 1 illustrates the relation between the degree of vacuum and the argon pressure at the sputtering step.

In FIG. 1, the region A is the region in which an excellent metal film in which hardly any cracks are formed is obtained.

The thickness of the metal film is ordinarily 300 to 2000 Å, preferably 350 to 500 Å, in the present invention. If the thickness of the metal film is too small, a metal film exhibiting a good metallic luster cannot be obtained.

In the present invention, austenitic stainless steels such as SUS 305, SUS 309, SUS 310, SUS 316, SUS 317, SUS 321 and SUS 347 are preferably employed.

Step (c)

In the subsequent step (c), a coating paint comprising as main components an acryl polyol having an OH value of 10 to 200 and an acid value of 1 to 12 and a non-yellowing polyisocyanate is coated on the surface of the metal film layer and is then cured to form a top coat layer.

The top coating paint that is used in the present invention comprises as main components an acryl polyol and a non-yellowing polyisocyanate.

In the present invention, it is indispensable that the acryl polyol to be used should have an OH value of about 10 to about 200, preferably about 40 to about 100, and an acid value of about 1 to about 12. Within the above ranges, a coating having good adhesion to the metal film and good weatherability can be obtained.

When the OH value is smaller than about 10, the solvent resistance of the coating is not so good. On the other hand, when the OH value is larger than about 200, cracks are readily formed on the coating, and further it is not preferably in view of the economical standpoint since a large amount of polyisocyanate should be used.

When the acid value is smaller than about 1, the adhesion to the metal film is low and yellowing is readily caused under forced drying, and therefore, good results cannot be obtained. When the acid value is larger than about 12, cracks or pinholes are readily formed on the coating and the weatherability is degraded, and therefore, too large an acid value is not preferred.

It is preferred that the equivalent ratio (OH/NCO) of the OH groups in the acryl polyol to the NCO groups in the polyisocyanate be in the range of from 0.6 to 1.2. Within this range, cross-linking effectively advances, and a coating excellent in such properties as weatherability, moisture resistance, water resistance and abrasion resistance can be obtained.

As typical instances of the acryl polyol component that is used in the present invention, there can be mentioned copolymers of at least two monomers selected from esters of $\alpha,\beta$-unsaturated carboxylic acids such as methyl acrylate, methyl methacrylate, ethyl acrylate, ethyl methacrylate, 2-ethylhexyl acrylate and 2-ethylhexyl methacrylate, monobasic acids having a linkage $>C=C<$, such as acrylic acid, methacrylic acid and itaconic acid, polybasic acids having a linkage $>C=C<$, such as itaconic acid and fumaric acid, compounds having a linkage $>C=C<$ and an —OH group, such as 2-hydroxyethyl acrylate, 2-hydroxyethyl methacrylate, 2-hydroxypropyl acrylate, 2-hydroxypropyl methacrylate, ethylene glycol monoacrylate and ethylene glycol monomethacrylate, compounds having linkage $>C=C<$ and

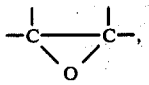

such as glycidyl acrylate and glycidyl methacrylate, compounds having a linkage $>C=C<$ and a —$CONH_2$ group, such as acrylamide and methacrylamide, and styrene methylstyrene, vinyl toluene and the like.

As the non-yellowing polyisocyanate component that is used in the present invention, there can be mentioned, for example, 1,6-hexamethylene diisocyanate, isophorone diisocyanate, xylene diisocyanate, 2,2,4-trimethylhexamethylene diisocyanate, lysine diisocyanate and dicyclohexylmethane diisocyanate.

The top coating paint that is used in the present invention comprises, in addition to the above main components, a solvent component such as xylol or butyl acetate and various additives. Further, a modifier such as a cellulose derivative, an epoxy resin, a polyester resin or an amino resin may be incorporated into the top coating paint according to need.

The top coating paint is coated according to a customary coating method such as brush coating, spray coating, dip coating, curtain flow coater coating or roller coating.

The coated paint is dried at normal temperatures or forcibly dried at about 50° to about 80° C. It is ordinarily preferred that the dry thickness of the top coat layer be about 10 to about 30$\mu$.

When the above-mentioned steps (a), (b) and (c) are conducted, there can be obtained an excellent molded article having a metallic luster, which comprises a metal film in the surface layer portion of a plastic molded article.

Effects attained by the present invention are as follows.

In the present invention, no chemicals apt to cause environmental pollution such as, for example, chromic acid, are used as in the electrolytic plating process. Further, a large quantity of water is not required, and therefore, it is not necessary to conduct a waste water treatment. A metal film having a metallic luster comparable or superior to the luster attainable by the electrolytic plating finish can be obtained.

Still further, almost no cracks are formed on the metal film obtained according to the present invention, and the article obtained is excellent in weatherability and abrasion resistance.

Therefore, the process of the present invention can be applied broadly in various fields, and especially when the present invention is applied to exterior decoration of automobiles, excellent effects and advantages can be attained.

The present invention will now be described in detail by reference to the following Examples that by no means limit the scope of the invention. In these Examples, all of "parts" are by weight.

EXAMPLE 1

An ABS resin molded article degreased by 1,1,2-trichloro-1,2,2-trifluoroethane (solvent) was spray-coated with an undercoating paint having the following composition:

| Composition of Undercoating Paint: | |
|---|---|
| Epoxy-modified acrylic resin (Diabeam K-6105A manufactured by Mitsubishi Rayon K.K.) | 50 parts |
| Polyester-modified acrylic resin (Diabeam K-4116 manufactured by Mitsubishi Rayon K.K.) | 50 parts |
| Methyl methacrylate | 40 parts |
| Xylol | 60 parts |
| 2-Ethoxyacetophenone | 2 parts |
| Polyoxyalkylene silicone copolymer leveling agent | 1 part |

After 10 minutes' setting at room temperature, the coated surface was irradiated for 60 seconds with ultraviolet rays by a 5 KW high pressure mercury lamp to form a base coat layer having a pencil hardness of F and a thickness of 15μ.

By using a direct current two-electrode magnetron sputtering apparatus, sputtering was carried out under conditions described below to obtain a metal film of chromium having a thickness of 500 Å.

Sputtering Conditions:

Degree of vacuum $8\times10^{-5}$ Torr

Argon pressure: $5\times10^{-4}$ Torr

Voltage: 500 V

Current density: 2 A/dm$^2$

Discharge time: 80 seconds

A top coating paint having the following composition was spray-coated on the so formed metal film layer.

| Composition of Top Coating Paint: | |
|---|---|
| Resin solution (non-volatile component content = 50% by weight; viscosity = S-W) of acryl polyol having OH value of 50, acid value of 3.0 and glass transition temperature of 80° C. | 100 parts |
| Desmodur N-75 (biuret compound of hexamethylene diisocyanate manufactured by Bayer) | 15 parts |
| Xylol | 50 parts |
| Butyl acetate | 30 parts |
| Cellosolve acetate | 20 parts |

After 10 minutes' setting at room temperature, the coated surface was forcibly dried at 60° C. for 30 minutes to obtain a top coat layer having a thickness of 20μ.

The resulting plastic molded article had a luster comparable or superior to the luster attainable by electrolytic plating finish.

After the forced drying, the plastic molded article was allowed to stand at room temperature for 7 days, and various property tests were carried out to obtain the results shown in Table 1.

EXAMPLE 2

In the same manner as described in Example 1, a base coat layer was formed on an ABS resin molded article, and a metal film of stainless steel SUS 310S (comprising 0.08% of C, 1.50% of Si, 2.00% of Mn, 0.04% of P, 0.03% of S, 20.00% of Ni, 25.00% of Cr and 51.35% of Fe) having a thickness of 450 Å was formed on the surface of the base coat layer under the following sputtering conditions by using a direct current two-electrode magnetron sputtering apparatus.

Sputtering Conditions:

Degree of vacuum: $1\times10^{-4}$ Torr

Argon pressure: $5\times10^{-4}$ Torr

Voltage: 200 V

Current density: 2 A/dm$^2$

Discharge time: 80 seconds

A top coating paint having the following composition was spray-coated on the surface of the so formed metal film.

| Composition of Top Coating Paint: | |
|---|---|
| Resin solution (non-volatile component content = 50% by weight; viscosity = S-W) of acrylic polyol having OH value of 100, acid value of 6.0, average molecular weight of 15,000 and glass transition temperature of 70° C. | 100 parts |
| Desmodur N-75 | 25 parts |
| Xylol | 60 parts |
| Butyl acetate | 30 parts |
| Cellosolve acetate | 30 parts |

After 10 minutes' setting at room temperature, the coated surface was forcibly dried at 60° C. for 30 minutes to obtain a top coat layer having a thickness of 18μ.

The so formed plastic molded article had a luster comparable or superior to the luster attainable by electrolytic plating finish.

After the forced drying, the plastic molded article was allowed to stand at room temperature for 7 days, and various property tests were carried out to obtain the results shown in Table 1.

EXAMPLE 3

A base coat layer and a metal film of chromium were formed on the surface of an ABS resin molded article in the same manner as described in Example 1, and a top coating paint having the following composition was spray-coated on the metal film.

| Composition of Top Coating Paint: | |
|---|---|
| Resin solution (having non-volatile component content = 50% by weight and viscosity of S-W) of acryl polyol having OH value of 50, acid value of 10.0 and glass transition temperature of 80° C. | 100 parts |
| Desmodur N-75 | 15 parts |
| Xylol | 50 parts |
| Butyl acetate | 30 parts |

-continued

| Composition of Top Coating Paint: | |
|---|---|
| Cellosolve acetate | 20 parts |

After 10 minutes' setting at room temperature, the coated surface was forcibly dried at 60° C. for 30 minutes to form a top coat layers having a thickness of 17μ.

The so obtained plastic molded article had a luster comparable or superior to the luster attainable by electrolytic plating finish.

After the forced drying, the plastic molded article was allowed to stand stationary at room temperature for 7 days, and various property tests were carried out to obtain the results shown in Table 1.

COMPARATIVE EXAMPLE 1

A plastic molded article was prepared in the same manner as described in Example 1 except that the undercoating paint was irradiated for 45 seconds with ultraviolet rays from a 5 KW high pressure mercury lamp to form a base coat layer having a pencil hardness of B and a thickness of 16μ. Results of various property tests are shown in Table 1.

As will be apparent from Table 1, in comparative Example 1 where the pencil hardness of the base coat layer was B, cracks were formed after 1 hour in the heat resistance test, whereas in Example 1 in which the pencil hardness of the base coat layer was F, cracks were not formed even after 24 hours, meaning that excellent heat resistance was attained.

COMPARATIVE EXAMPLE 2

A plastic molded article was prepared in the same manner as in Example 1 except that a top coat layer having a thickness of 18μ was formed by using the following top coating paint.

| Composition of Top Coating Paint: | |
|---|---|
| Resin solution (non-volatile component content = 70% by weight; viscosity = S-W) of acryl polyol having OH value of 50, acid value of 13.1, average molecular weight of 20000 and glass transition temperature of 66° C. | 100 parts |
| Desmodur N-75 | 15 parts |
| Xylol | 50 parts |
| Butyl acetate | 30 parts |
| Cellosolve acetate | 20 parts |

Results of various property tests of the so formed plastic molded article are shown in Table 1.

As will be apparent from Table 1, in Comparative Example 2 where acryl polyol having an acid value larger than 12 was employed, the weatherability was extremely poor, whereas in Examples where acryl polyols having an acid value smaller than 12 were used, opacification was not caused and hence, it was confirmed that excellent weatherability could be attained.

Table 1

| Test Items | Example 1 | Example 2 | Example 3 | Comparative Example 1 | Comparative Example 2 | Conventional Product(1) |
|---|---|---|---|---|---|---|
| Pencile Hardness(2) | H | H | H | H | H | H |
| Weatherability(3) | | | | | | |
| 400 hours | not changed | not changed | not changed | not changed | not changed | opacification and peeling |
| 800 hours | not changed | not changed | not changed | not changed | opacification | |
| Moisture Resistance(4) | | | | | | |
| 400 hours | not changed | not changed | not changed | not changed | not changed | opacification and peeling |
| 1200 hours | not changed | not changed | not changed | not changed | not changed | |
| Water Resistance(5) | | | | | | |
| 400 hours | not changed | not changed | not changed | not changed | not changed | opacification and peeling |
| 1200 hours | not changed | not changed | not changed | not changed | not changed | |
| Heat Resistance(6) | | | | | | |
| 1 hour | not changed | not changed | not changed | cracks | not changed | cracks |
| 24 hours | not changed | not changed | not changed | | not changed | |
| Salt Spray Resistance(7) | | | | | | |
| 400 hours | not changed | not changed | not changed | not changed | not changed | opacification and peeling |
| 1200 hours | not changed | not changed | not changed | not changed | not changed | |
| Abrasion Resistance(8) | | | | | | |
| 10000 times | not changed | not changed | not changed | not changed | not changed | exposure of substrate |
| 50000 times | not changed | not changed | not changed | not changed | not changed | |

Note (1)Molded article having a base coat layer of an acryl lacquer formed on the surface of an ABS resin molded article, an aluminum film layer formed on the base coat layer by vacuum deposition and a top coat layer of an acryl lacquer formed on the metal film layer.

(2)Determined according to JIS D-0202.

(3)The surface condition was examined after exposure to a sunshine type weatherometer.

(4)The surface condition was examined after standing in an atmosphere maintained at a temperature of 40° C. and a relative humidity of 95%.

(5)The surface condition was examined after dipping in service water maintained at 40° C.

(6)The surface condition was examined after standing in a thermostat tank maintained at 80° C.

(7)Determined according to JIS Z-2371-1955.

(8)The surface condition was examined after the test using a reciprocative abrasion tester having a contact surface composed of a canvas under a load of 1 Kg.

What we claim is:

1. A process for the preparation of plastic molded articles having a metal film, which comprises the steps of (a) coating an ultraviolet-curing acrylic resin undercoating paint on the surface of a plastic molded article and irradiating the coated surface with ultraviolet rays to form a base coat layer, (b) forming on the base coat layer a metal film of chromium or stainless steel by the sputtering process under conditions of a degree of vacuum of $6\times10^{-5}$ to $1\times10^{-3}$ Torr, an argon pressure of $1\times10^{-4}$ to $5\times10^{-3}$ Torr, a voltage of 200 to 600 V and a cathode current density of 0.2 to 5 A/dm$^2$, and (c) coating on the metal film a top coating paint comprising as main components an acryl polyol having an OH value of 10 to 200 and an acid value of 1 to 12 and a non-yellowing polyisocyanate and curing the coated paint to form a top coat layer.

2. A process for the preparation of plastic molded articles having a metal film according to claim 1 wherein the base coat layer has a hardness not lower than HB as determined according to the method of JIS D0202.

3. A process for the preparation of plastic molded articles having a metal film according to claim 1 wherein the metal film of chromium or stainless steel formed by the sputtering process has a thickness of 300 to 2000 Å.

4. A process for the preparation of plastic molded articles having a metal film according to claim 1 wherein the top coating paint comprises the acryl polyol and non-yellowing polyisocyanate in such amounts that the equivalent ratio OH/NCO of the OH groups of the acryl polyol to the NCO groups of the non-yellowing polyester is in the range of from 0.6 to 1.2.

5. A process for the preparation of plastic molded articles having a metal film according to claim 1 wherein the coefficient of thermal expansion of the plastic molded article is less than $20\times10^{-5}$ cm/cm/°C.

6. A process for the preparation of plastic molded articles having a metal film according to claim 1 wherein the material of the plastic molded article is an acrylonitrile-butadiene-sytrene copolymer or an acrylonitrile-styrene copolymer.

* * * * *